United States Patent [19]

Thouron

[11] Patent Number: 5,016,836

[45] Date of Patent: May 21, 1991

[54] GUIDANCE/CONTROL DEVICE FOR A CARRIER COMPRISING A MOVABLE NOZZLE

[75] Inventor: René Thouron, La Ferte St. Aubin, France

[73] Assignee: Thomson-Brandt Armements, Boulogne Billancourt, France

[21] Appl. No.: 381,866

[22] Filed: Jul. 19, 1989

[30] Foreign Application Priority Data

Jul. 22, 1988 [FR] France ..... 88 09941

[51] Int. Cl.[5] ..... F42B 10/66

[52] U.S. Cl. ..... 244/3.22

[58] Field of Search ..... 244/3.21, 3.22

[56] References Cited

U.S. PATENT DOCUMENTS

| | | | |
|---|---|---|---|
| 3,328,962 | 7/1967 | De Feo et al. | 60/228 |
| 3,446,436 | 5/1969 | Desjardins et al. | 239/265.25 |
| 4,463,921 | 8/1984 | Metz | 244/3.22 |
| 4,482,107 | 11/1984 | Metz | 244/3.22 |
| 4,589,594 | 5/1986 | Kranz | 239/265.25 |
| 4,646,991 | 3/1987 | Kranz | 244/3.22 |
| 4,681,283 | 7/1987 | Kranz | 244/3.22 |
| 4,691,876 | 9/1987 | Kranz | 244/3.22 |

FOREIGN PATENT DOCUMENTS

| | | | |
|---|---|---|---|
| 0110774 | 6/1984 | European Pat. Off. . | |
| 1147144 | 9/1958 | Fed. Rep. of Germany | 244/3.22 |
| 3108283 | 9/1982 | Fed. Rep. of Germany . | |
| 3138869 | 4/1983 | Fed. Rep. of Germany . | |

*Primary Examiner*—Deborah L. Kyle
*Assistant Examiner*—Richard W. Wendtland
*Attorney, Agent, or Firm*—Oblon, Spivak, McClelland, Maier & Neustadt

[57] ABSTRACT

Disclosed is a gas jet device within at least one movable nozzle in rotation, enabling the creation of one or more thrust forces providing for the guidance-control of a carrier. The guidance-control device has a nozzle unit to which a nozzle is fixed. The nozzle, through the movable nozzle unit, is put into rotation by a rotation-driving device which may be, for example, a rotation-driving device. This pneumatic control device has a control piston provided with a rack device and cylindrical chambers. Through a gas distribution system, these cylindrical chambers undergo pressure variations which give the piston a translational motion. This piston transmits a rotational motion, through a toothed wheel, to the nozzle unit and, hence, to the nozzle. With a gas generator feeding the nozzle or nozzles, and with the guidance-control mode being chosen, all that remains is to position the nozzle or nozzles according to the desired aperture angle to obtain the desired direction.

12 Claims, 2 Drawing Sheets

GUIDANCE/CONTROL DEVICE FOR A CARRIER COMPRISING A MOVABLE NOZZLE

BACKGROUND OF THE INVENTION

1. Field of the Invention

The invention concerns a guidance/control device using gas jets by means of at least one rotating, movable nozzle in order to create one or more thrust forces enabling the guidance of a carrier in a determined direction.

A guided carrier notably has propulsion means that operate on the entire trajectory of the carrier or on a part of this trajectory, means designed to measure the deviations in the trajectory of this carrier with respect to the position of a designated target and guidance/control means enabling the deviations to be corrected. The deviations in the trajectory of a guided carrier can be corrected by the application of a thrust force to a determined point of the carrier. This thrust force may be created by aerodynamic devices or by pyrotechnical devices such as gas jets. A device for guidance/control by gas jets, designed to modify the trajectory of a carrier, comprises an energy source that generates a gas flux, a set of one or more nozzles distributed on the body of the engine, and a means enabling the gas flux to be routed according to control commands available on board the carrier so as to create a resultant thrust force with a determined magnitude and direction.

2. Description of the Prior Art

There are already known approaches to attain the above-mention goals. These include:

the use of one or more (fixed) nozzle(s) wherein a flux of gas is directed as required, the position of said nozzle(s) corresponding to the desired maneuver. This approach entails making a very complicated device for switching over the gas flux, and the difficulty of making it increases with the magnitude of the thrust force exerted by the gas flux;

the use of a nozzle that pivots on a toggle joint located on an axis parallel to the axis of the carrier; in this case, problems of imperviousness arise at the link between the nozzle and the toggle joint;

the use of a single fixed nozzle with the positioning of the carrier in such a way that the axis of this nozzle is properly oriented. This approach results in a maneuver of the carrier prior to the application of the desired force: this may lead, in particular, to reaction times that are incompatible with the guidance equations used;

the use of a nozzle pivoting on a point generally located on the axis of the engine in the vicinity of the propulsion units of the carrier with a very small angular clearance. In this case, the forces used are tapped from the thrust force of the motor. This results, firstly, in a modification of the direction of the forces and, secondly, in guidance and control that is limited to the period of operation of the main motor.

The aim of the invention is to overcome these drawbacks by proposing a guidance/control device making it possible for a thrust force, coming from a continuous gas flux within a fixed nozzle, on a nozzle unit, to obtain different motions of the carrier depending on the orientation of the thrust force, the latter having at least one radial component, i.e. one located in a plane perpendicular to the longitudinal axis of the carrier.

SUMMARY OF THE INVENTION

An object of the invention is a device for the guidance and/or control of a carrier having at least one nozzle through which there is an outgoing of a thrust force generated by the continuous passage of a gas flux coming from a continuous gas jet generator, a device wherein the nozzle is fixed to a cylindrical nozzle unit within which the continuous gas flux flows towards the nozzle and causes a rotational motion through a rotation-driving device.

BRIEF DESCRIPTION OF THE DRAWINGS

The invention and its characteristics will be better understood from the following description, illustrated by the appended figures, of which.

DETAILED DESCRIPTION OF THE PREFERRED EMBODIMENTS

Figure 1:
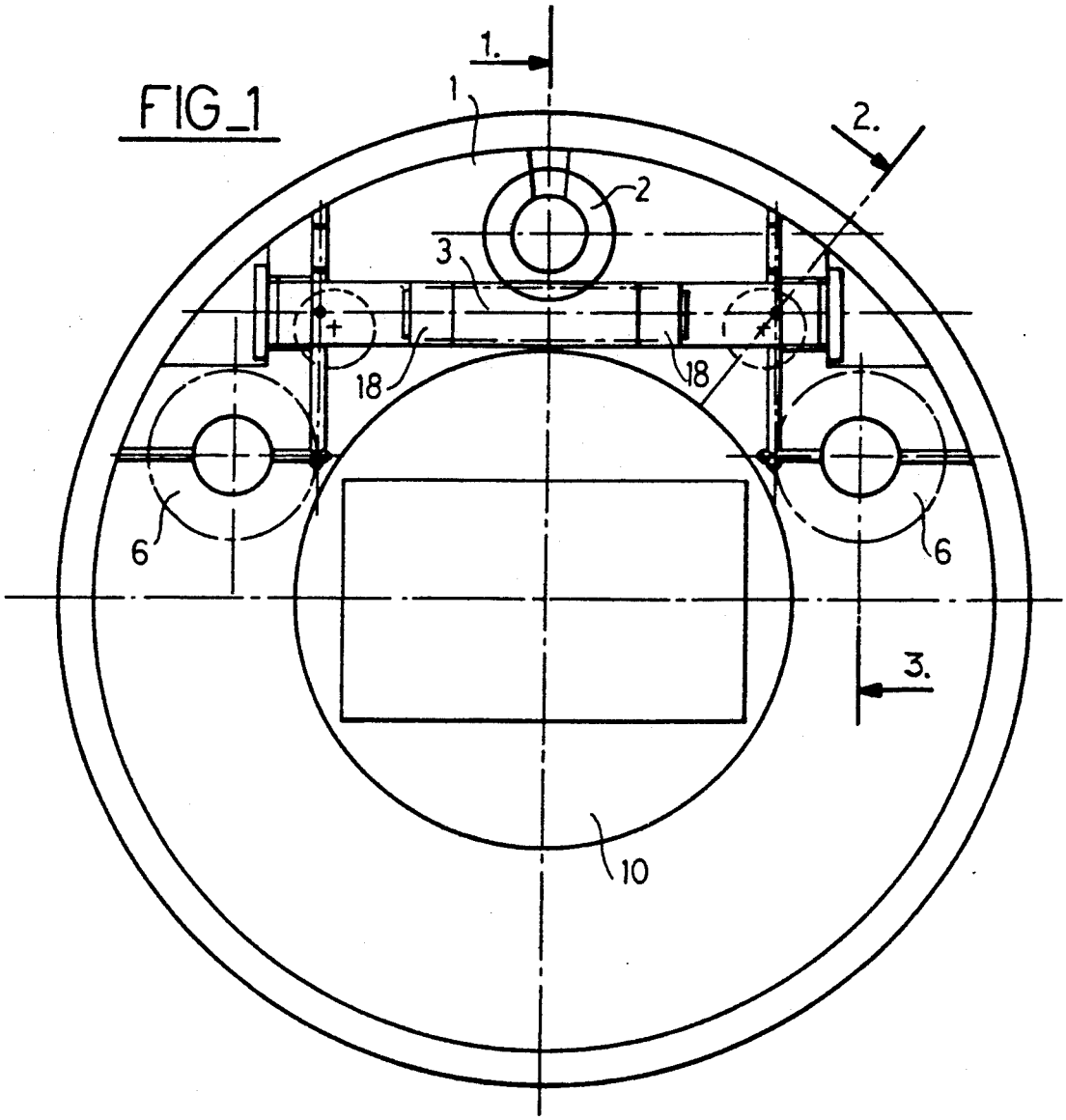
FIG. 1 shows a longitudinal section of a carrier fitted out with the guidance/control device according to the invention.

FIG. 1 shows a longitudinal section of a carrier fitted out with a guidance/control device according to the invention. This device is generally placed in the vicinity of a gas generator which feeds the rotating, movable tubes. Depending on the effect desired, this device may be placed in front of the carrier, at its center of gravity or behind it. It performs its guidance function when a change in trajectory is made, and it performs its control function when a stabilization is done around the center of gravity. The guidance/control device is borne by a supporting body 1. This supporting body 1 is, for example, a ring-shaped body provided with one or more movable nozzle units 2 as well as with the rotation-driving device or devices. It is placed facing the gas generator which is not shown in this figure. The movable nozzle unit 2 consists of three elements (a nozzle unit, one or more seals and a rotation-driving device) which are not seen in this figure but will be shown in detail in FIG. 2. This nozzle unit is linked to a control piston 3 by means of the rotation-driving device. This control piston 3 is perpendicular to the nozzle unit and enables it to be made to rotate by means of the rotation-driving device. For, the angular clearance obtained has wide amplitude (nearly 180°) thus enabling great freedom of guidance. At each of its ends, this control piston 3 has chambers 18, for example cylindrical, with or without seals. After an energy source is put into operation, these chambers are at a determined pressure which can vary by means of distributors 6 placed on either side of the chambers of the control pistons 3. These distributors 6 enable the creation of a depression by putting either of the chambers of the control piston 3 into contact with the open air. This control piston 3 is then driven by a translational motion driving the nozzle unit to the desired position, notably through a rack device 22 with which the control piston 3 is provided, and through the rotation-driving device between the nozzle unit and the control piston. These distributors 6 are, for example, one-way distributors with mechanical closing and opening by the control of a coil. This coil can be controlled by an automatic control loop linked to position sensors that are not shown in this figure but are fixed to the rear of the supporting body 1, making it possible to detect the portion of the nozzle unit 2 and to position the nozzle unit with respect to an aperture angle chosen by the guidance/control mode for the orientation of the thrust force. The above-described rotation-driving device is a pneumatic control device, but it is possible to use an electric motor which puts the nozzle unit into rotation, either directly or through a gear system to remove unwanted torque forces due to the assembly, or again, a mechanical control connecting several nozzles to one and the same electrical or pneumatic actuator. As shown in the drawing of FIG. 1, the guidance-control device located around the main axis of the carrier permits the use of a warhead for example a hollow charge, since this guidance/control device surrounds the unoccupied space 10.

In the example described, the nozzle device of the guidance/control device is made to rotate on an axis parallel to the longitudinal axis of the carrier, but this guidance/control device can be made by using different planes of inclination for the nozzle unit or for the nozzle fixed to the nozzle unit, the main feature being the fixed position of the nozzle on the nozzle unit.

Figure 2:
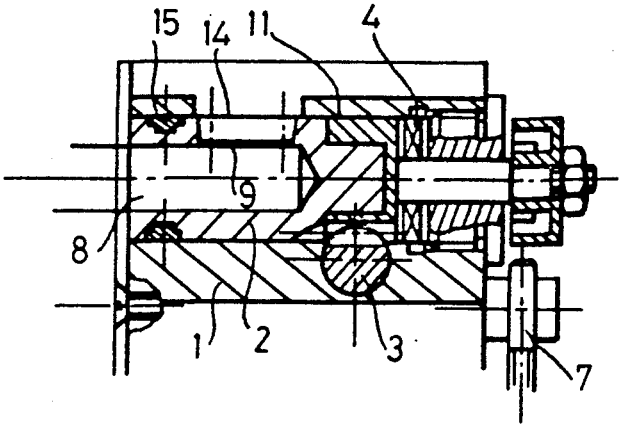
FIG. 2 shows a section A, through FIG. 1, of the guidance/control device according to the invention.
Figure 3:
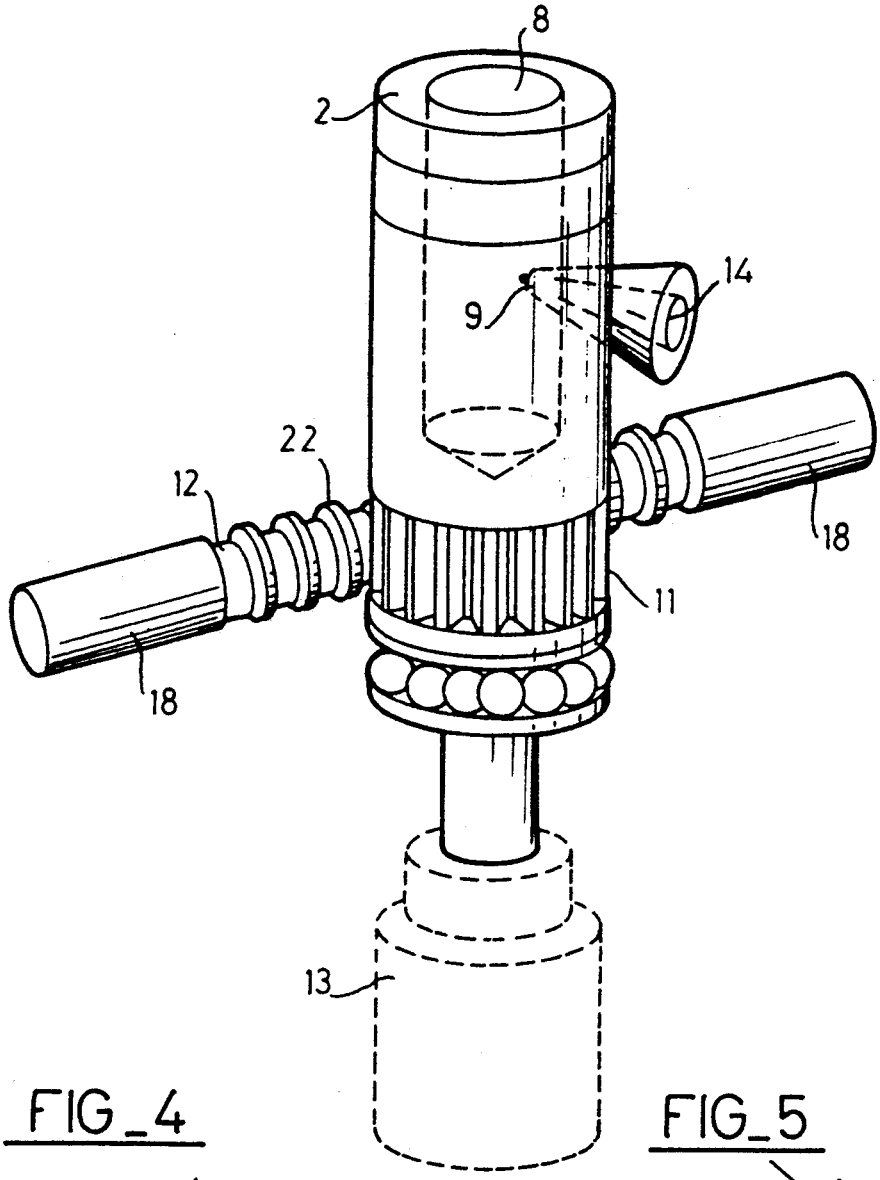
FIG. 3 is a drawing of the elements of the guidance/-control device and of the rotation-driving devices.

FIG. 2 shows a section A, through FIG. 1, of the guidance/control device according to the invention. The supporting body 1 supports the nozzle unit 2 which is made up of several elements. These elements are shown separately in FIG. 3. In this FIG. 3, the nozzle unit 2 is a cylinder in stages, with a central blind hole 8, enabling the passage of the gas flux coming, for example, from a gas generator, towards a nozzle 14, through a neck 9 of the nozzle 14. This neck 9 may be cylindrical or oblong shaped for reasons related to space factor. The nozzle 14 is fixed to the nozzle unit 2, connected to the central blind hole 8 to prevent problems of imperviousness caused by the use of a pivoting nozzle. Behind the nozzle unit 2, there may or may not be a seal and, above all, there is a rotation-driving device formed, for example, by a toothed wheel 11 mounted on the nozzle unit 2 by a fixed link. This toothed wheel 11 provides for the connection with the control piston 12 forming the above-described pneumatic control device. The device, provided with an electrical motor 13, is also shown in dashes in this FIG. 3. It is clear that both these devices are not used at the same time. There also exists, notably behind the nozzle unit 2, a pin stop 4 with the role of absorbing the force due to the pressure of the gas generator, which is exerted on the nozzle unit when the gas generator is started up. A position sensor 7 is placed behind the supporting body 1 to enable detection of the position of the nozzle 14 and to create or not create an automatic control loop to obtain a gradual rotation. The guidance-control device may also be used in steps with angle apertures, for example of 10°, 20°, 30°, 60°, 90°, 120°, requiring no automatic control loop but directly given as a function of the chosen guidance-control operation. In this entire guidance-control device, it is preferable to use seals having different functions. One of these seals, 22, can be used, through its extensibility, to let through gases coming from the gas generator. Other seals, not shown, isolate the leakages and load losses towards the nozzle and the control part of the nozzle unit.

Figure 4:
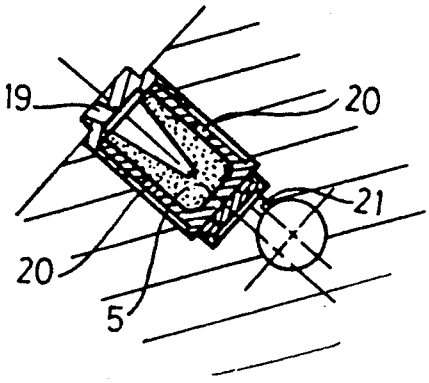
FIG. 4 shows a section B, through FIG. 1, of the filter placed in the gas distribution system.

To facilitate the working of the solenoid valves enabling the gases to pass from the coil distributor to the chambers of the control piston, a filter 5 is placed in the gas distribution system. It is shown in the drawing of FIG. 4 and enables the retention of the particles existing in the gas, the dimensions of which may compromise the working of the solenoid valves. The gases are conveyed to the interior of the filter 5 made, for example, of porous ceramic, through the end 19. Outlets 20 make it possible for the gas flux to continue on its path and to be recovered, in a filtered state, at the end 21 after passing through various conduits.

Figure 5:
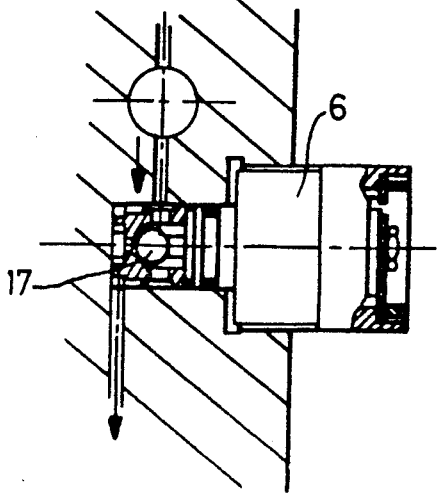
FIG. 5 shows a section C, through FIG. 1, of a coil distributor that can enable the passage of a gas flux.

FIG. 5 shows a cross section C, through FIG. 1, of a distributor 6 that permits or does not permit the passage of a flux of gas coming from a gas generator. This distributor 6 is provided with a bead 17 which, when the coil of the distributor is excited by a command coming from the pilot on board, is drawn towards the distributor 6. An unoccupied space is then created, and causes an outward escape of a gas flux creating a dispersal within one of the chambers of the control piston which undergoes a translational motion. This movement causes a rotational motion of the nozzle unit in a determined position, the command for the end of excitation of the coil being given by the pilot on board through position sensors.

This guidance/control arrangement enables a continuous flow of the gas flux within the nozzle, owing to the movement of the nozzle, without any blocking of its neck, thus letting the gas flux pass through. This continuous flow gives an orientation (of the carrier) which could be free of jolts and prevents the pneumatic hammer phenomenon encountered in other mechanisms. The guidance-control device can be used, depending on the guidance-control principle used, with one or more nozzle units enabling the performance of yawing and pitching motions with or without roll. The difference between these guidance-control systems is obtained by the number of nozzle units used, but also by the aperture angle given to these nozzle units. It is possible to envisage the application of this control device in fields other than that of weapons, for example the field of space applications where problems of orientation are frequent and difficult to cope with.

What is claimed is:

1. A device for at least one of guidance and control of a carrier having a longitudinal center axis, the device comprising:

at least two cylindrical nozzle units each having an axis of rotation parallel to the longitudinal center axis of the carrier;

at least one nozzle fixed to each of the cylindrical nozzle units by a neck for conducting a continuous flow of gas to generate continuously a thrust force having a transverse outwardly directed component; and a rotating-driving device for rotating each of the cylindrical nozzle units about their respective axes of rotation by 180 degrees and less and for orienting each at least one nozzle of the respective cylindrical nozzle units to steer the carrier.

2. A device according to claim 1, wherein the axis of rotation of at least one of the at least two nozzle units is spaced from the longitudinal center axis of the carrier.

3. A device according to claim 1, wherein a number of nozzles is determined according to a guidance/control equation to obtain an improved stabilization.

4. A device according to claim 1, wherein the rotating-driving device includes a pneumatic control device.

5. A device according to claim 4, wherein the pneumatic control device has a control piston provided with a rack device and, at each of its ends, a cylindrical chamber.

6. A device according to claim 5, wherein the rack device is in contact with a toothed wheel giving the rotational motion to the associated nozzle unit.

7. A device according to claims 5 or 6, wherein each cylindrical chamber is in relation with a distributor enabling the creation of a depression in one of the cylindrical chambers of the control piston and, hence, capable of conveying a translational motion to said piston.

8. A device according to claim 1, wherein each of the nozzle units has a wide amplitude angular clearance.

9. A device according to claim 8, wherein the angular clearance varies substantially from 0° to 180°.

10. A device according to claim 1, wherein a pin stop is positioned behind the associated nozzle unit to absorb the stress due to the pressure of the gas generator.

11. A device for at least one of guidance and control, the device comprising:

a carrier having a longitudinal center axis;

at least two cylindrical nozzle units each having an axis of rotation parallel to the longitudinal center axis of the carrier;

at least one nozzle fixed to each of the cylindrical nozzle units by a neck for conducting a continuous flow of gas to generate continuously a thrust force having a transverse outwardly directed component; and a rotating-driving device for rotating each of the cylindrical nozzle units about their respective axes of rotation by 180 degrees and less and for orienting each at least one nozzle of the respective cylindrical nozzle units to steer the carrier.

12. A device according to claim 11, wherein the axis of rotation of at least one of the at least two nozzle units is spaced from the longitudinal center axis of the carrier.

* * * * *